US006154139A

United States Patent [19]

Heller

[11] Patent Number: 6,154,139

[45] Date of Patent: Nov. 28, 2000

[54] METHOD AND SYSTEM FOR LOCATING SUBJECTS WITHIN A TRACKING ENVIRONMENT

[75] Inventor: Alan C. Heller, Dallas, Tex.

[73] Assignee: Versus Technology, Traverse City, Mich.

[21] Appl. No.: 09/063,715

[22] Filed: Apr. 21, 1998

[51] Int. Cl.[7] ..... G08B 23/00

[52] U.S. Cl. ..... 340/573.4; 340/572.1

[58] Field of Search ..... 340/573.1, 573.4, 340/572.1, 311.1, 825.44, 825.34; 379/38

[56] References Cited

U.S. PATENT DOCUMENTS

| | | | |
|---|---|---|---|
| 4,462,022 | 7/1984 | Stolarczyk | 340/506 |
| 4,906,853 | 3/1990 | Linwood et al. | 340/600 X |
| 4,924,211 | 5/1990 | Davies | 340/573 |
| 4,982,176 | 1/1991 | Schwarz | 340/567 |
| 5,017,794 | 5/1991 | Linwood et al. | 340/600 X |
| 5,027,314 | 6/1991 | Linwood et al. | 340/573 X |
| 5,119,104 | 6/1992 | Heller | 342/450 |
| 5,218,344 | 6/1993 | Ricketts | 340/573 |
| 5,228,449 | 7/1993 | Christ et al. | 128/691 |
| 5,276,496 | 1/1994 | Heller et al. | 356/141 |
| 5,283,549 | 2/1994 | Mehaffey et al. | 340/521 |
| 5,301,353 | 4/1994 | Borras et al. | 340/539 X |
| 5,355,222 | 10/1994 | Heller et al. | 356/375 |
| 5,382,948 | 1/1995 | Richmond | 340/825.36 |
| 5,387,993 | 2/1995 | Heller et al. | 359/155 |
| 5,440,559 | 8/1995 | Gaskill | 340/825.34 X |
| 5,465,082 | 11/1995 | Chaco | 340/825.54 |
| 5,548,637 | 8/1996 | Heller et al. | 379/201 |
| 5,570,079 | 10/1996 | Dockery | 340/541 |
| 5,572,195 | 11/1996 | Heller et al. | 340/825.35 |
| 5,578,989 | 11/1996 | Pedtke | 340/539 |
| 5,610,589 | 3/1997 | Evans et al. | 340/573.1 |
| 5,673,032 | 9/1997 | Ono | 340/825.44 |

*Primary Examiner*—Thomas Mullen
*Attorney, Agent, or Firm*—Brooks & Kushman P.C.

[57] ABSTRACT

A method and system utilize both the radio frequency (RF) and infrared (IR) parts of the electromagnetic spectrum to locate subjects (i.e. objects and persons) within a tracking environment. The system includes a battery-operated, microprocessor-based badge for each subject to be located. Each badge automatically transmits digitized infrared light signals to provide a fine determination of its subject's location. Each badge transmits RF and IR signals upon actuation of a page request/alert push button switch on its badge. An RF signal is also generated at a timed interval as a "heartbeat" pulse. This pulse informs the host computer that the badge is both present and fully functional. The IR and RF signals are modulated or encoded with badge identification data, page request or alert notification data, and battery condition data. The system also includes ceiling or wall sensors in the form of IR and RF receivers. Each RF sensor converts the encoded RF signals into a first set of electrical signals. Each IR sensor converts encoded IR signals into a second set of electrical signals. In turn, the first and second sets of electrical signals are transmitted to a micro-processor-based collector of the system. The locating method and system are particularly useful in hospitals to determine and monitor the location of patients and/or critical equipment.

12 Claims, 1 Drawing Sheet

METHOD AND SYSTEM FOR LOCATING SUBJECTS WITHIN A TRACKING ENVIRONMENT

TECHNICAL FIELD

Figure 1:
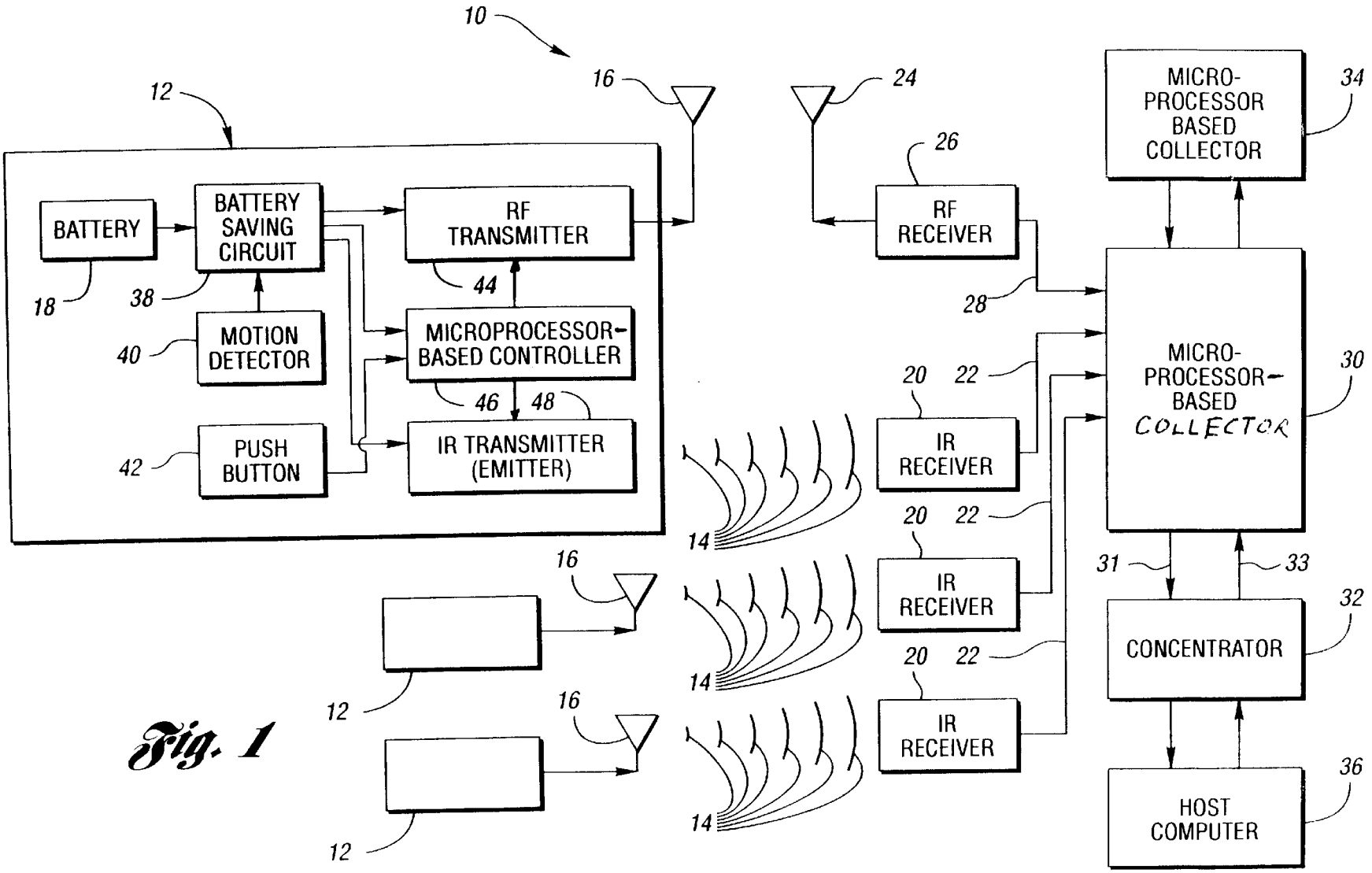

This invention relates to methods and systems for locating subjects within a tracking environment and, in particular, for methods and systems for locating subjects within a tracking environment wherein the system includes a tag for each subject to be located.

BACKGROUND ART

An identification system exists whereby a single microprocessor can simultaneously receive sensory input with its subcarrier removed and demodulate the data content on each sensory input. In turn, each sensory input can come from any number of different subcarriers. Such subcarriers include a 40 kHz infrared on/off shift key, and a 447.5 kHz infrared on/off shift key.

The ability to be somewhat media independent has assisted in solving different problems in locating technologies. Such problems include the changing from a low frequency IR carrier to a high frequency IR carrier. The use of higher frequency IR carriers (i.e. 447.5 kHz receivers) are much less likely to obtain optical interference signals caused by the use of newer kinds of fluorescent lighting.

Further use of other subcarriers used with this type of system is a frequency shift keyed (FSK) receiver with appropriate transmitters whose sole combined purpose is to transmit a 10 bit identification code when the transmitter's button is pushed, indicating a special event the user wishes to create. The sensor in this case has a microprocessor that completely demodulates the FSK received code and retransmits that code to a distant microprocessor in such a way that it looks like a demodulated signal from an IR sensor.

U.S. Pat. No. 5,301,353 to Borras et al. discloses a communication system and apparatus wherein the system utilizes one of two different types of communication methods, depending on the location of the user. When the user is in an on-site area, the user communicates via infrared techniques. When the user is in an off-site area, the user communicates using a different communication media, including an RF communication media.

U.S. Pat. No. 5,218,344 to Ricketts discloses a method and system for monitoring personnel in a facility, wherein the system utilizes two different types of communication devices. The system includes a central computer, a plurality of remotely located stationary transceivers, and a portable transceiver unit worn by each monitored individual. In operation, the main computer transmits command signals to a plurality of stationary transceivers using hardwire communication of acoustic, electromagnetic or optical communications. The stationary transceivers then broadcast interrogation signals to the portable transceiver units. The interrogation signals are transmitted via acoustic, electromagnetic or optical transmission methods. The method and system provides a verification of the location of individuals wearing the portable transceiver units.

U.S. Pat. No. 5,228,449 to Christ et al. discloses a system and method for detecting out-of-hospital cardiac emergencies and summoning emergency assistance. The system includes an infrared patient detecting system and an RF communication system. In operation, the infrared system is used to detect the presence and health of the patient. The infrared system provides information to the RF transmitter, which transmits the information to a central computer. The operator of the central computer is then able to monitor the health and presence of the patient via the infrared and radio frequency communication links.

U.S. Pat. Nos. 4,924,211 to Davies and 5,416,468 to Baumann disclose systems and methods for monitoring personnel, wherein the systems comprise both infrared and radio frequency communication devices.

U.S. Pat. Nos. 4,462,022; 4,982,176; 5,570,079; 5,283,549; and 5,578,989 show security systems using local infrared detecting devices which communicate with a central monitoring station via a radio frequency communication link.

U.S. Pat. No. 5,027,314 discloses a system and method for tracking a number of subjects in a plurality of areas. The system includes a plurality of transmitters associated with the subjects, a plurality of receivers associated with the areas and a centralized processor for determining in which of the areas the transmitter and, consequently, the subjects are located.

Each transmitter transmits a light-based signal, such as an infrared signal, representative of an identifying code unique to the transmitter. Each receiver validates the signal to determine whether the signals are representative of the unique identifying codes associated with the transmitters. The centralized processor records the validated signals and receivers, scans the receivers and accumulates areas and badge counts for each area.

U.S. Pat. No. 5,548,637 discloses an automated method and system for providing the location of a person or object (i.e. a subject) in the form of a message in response to a telephone caller's inquiry. The method and system may connect the caller directly to the telephone extension located nearest the subject of interest. A transmitter, such as an infrared transmitter, is attached to each subject to be monitored within a defined area such as a building. A number of receivers or sensors track the location of the subject within the building. The locations are stored in a database. In one form of the invention, as each transmitter is transported throughout the building, the system continually updates the transmitter location in the database.

U.S. Pat. No. 5,572,195 discloses a method and system for tracking an locating objects wherein the system includes a computer network, such as a local area network, a computer connected to the computer network, infrared sensors, and interface circuitry connecting the computer network to the infrared sensors. The infrared sensors are adapted to receive unique identifying codes from infrared transmitters and then provide the codes to the interface circuitry. In turn, the codes are then provided to the computer network. The invention may be implemented using an object identifier variable-based protocol such as SNMP (Simple Network Management Protocol). The system may include an external device controller, such as a relay controller, for controlling a physical device such as an electronic door lock within the environment.

U.S. Pat. No. 5,387,993 discloses various methods of transmitting data and control information such as battery life for badges (TAGs) to optical (i.e. infrared) receivers of an optical locator system. In one of the methods, the badges are "motion-detectabl" and have a sleep mode. The badges are reprogrammable with identifying information about the objects to which they are attached. Each badge activates the sleep mode, thereby reducing its normal power consumption. Each TAG will reactivate the sleep mode when motion is detected by the motion detector, thereby returning the battery power level to normal.

U.S. Pat. No. 5,119,104 discloses a radio-location system for multipath environments, such as for tracking objects in a facility, includes an array of receivers distributed within the tracking area, coupled to a system processor over a LAN. A TAG transmitter located with each object transmits, at selected intervals, spread spectrum TAG transmissions including at least a unique TAG ID. Object location is accomplished by time-of-arrival (TOA) differentiation, with each receiver including a TOA trigger circuit for triggering on arrival of a TAG transmission, and a time base latching circuit for latching the TOA count from an 800 MHz time base counter. In a low resolution embodiment, each receiver of the array is assigned a specific location-area, and receives TAG transmissions almost exclusively from TAGs located in that area, thereby eliminating the need for any time-of-arrival circuitry.

U.S. Pat. No. 5,276,496 discloses an optical receiver for use with an optical location system that locates a target in a defined area. A spherical lens is placed over the area. The area is divided into sections, with a sensor associated with each section. These sensors receive light transmitted through the lens, and are positioned relative to each other and with respect to the lens, such that each sensor receives emitted light from the same size section if the target is located in its section. The height of each sensor may be adjusted so that each sensor receives light of the same intensity if the target is located in its section.

U.S. Pat. No. 5,355,222 discloses an optical location system for locating the position of a moving object in a defined area. An optical transmitter is attached to the moving object. A stationary receiver has a number of sensors for receiving a signal from the transmitter. one sensor has a field of view of the entire area. other sensors have partially blocked fields of view, with the blocking being accomplished with nonopaque strips of decreasing width. These strips are arranged so that the detection or nondetection of light by the sensors can be digitally coded in a manner that corresponds to sections of the area.

U.S. Pat. No. 4,906,853 discloses a control apparatus f or triggering a periodic pulse at random times comprising a timer for variably issuing the periodic pulse in a defined time cycle and a signal generator for variably generating an output voltage within the defined cycle. The signal generator has a light sensitive component for varying in time the generation of the output voltage in proportion to the intensity of visible light incident on the light sensitive component. The apparatus also includes a circuit for applying the generated output voltage to the timer for triggering the issuance of the periodic pulses.

U.S. Pat. No. 5,017,794 discloses apparatus including a time for generating a periodic pulse in a defined time cycle in response to a control signal, and a signal generator for variably generating the control signal within the defined cycle. The signal generator includes a light sensitive component for varying in time the generation of the control signal in proportion to the light incident on the light sensitive component for a portion of the defined cycle.

SUMMARY OF THE INVENTION

An object of the present invention is to provide a method and system for locating subjects wherein the system includes a TAG for each subject to be located and wherein each TAG emits or transmits substantially line-of-sight and substantially non-line-of-sight signals. The signals in the preferred embodiment are RF and IR. The benefits of IR are two-fold, firstly, the cost of reception and transmission components are low. Secondly, the benefit of IR is its high line-of-sight nature. The use of this feature enables processing software to infer that the signal is highly proximate (line-of-sight or almost line-of-sight) to the transmitter. The ability to make this inference creates a much more precise location fix.

The use of RF obviates the requirement that a badge or TAG is line-of-sight when a push button of the TAG applied is pushed. Further, the requirement to have a sensor in every room is obviated and an RF sensor that receives button presses per every 10, 20 or 30 rooms is reasonable observing current FCC regulation and available low cost RF components.

Another object of the present invention is to provide a method and system for locating subjects wherein the system includes a TAG for each subject to be located and wherein each TAG includes a push button that causes RF signals to be emitted and a great certainty that the push button depressed is in the hands of a user whether or not at that moment the IR signal is seen. The processing software can then process the last known IR location for purposes of servicing the person who has pressed the push button.

Bathrooms are places where it can be difficult to put IR sensors and where people may object to a sensor being present. The processing software when receiving a button press from the RF sensor can then proceed to find the last known IR sensor reception (which will likely be outside the restroom) and hence the proper service can then be delivered to the person who pressed the push button.

Still another object of the present invention is to provide a method and system for locating subjects wherein the system includes a TAG for each subject to be located and wherein the TAG includes a single microprocessor which substantially develops the signals into both emitters or transmitters (RF oscillator and IR LED). The data modulation routines are substantially identical. However, the subroutines for the subcarriers may differ. For example, a 447.5 kHz signal when emitting a carrier ON pulse, will turn the IR LED on and off for so many microseconds (typically 120 us) whereas the RF data modulation routine might hold the carrier (i.e. oscillator) ON for the entire period.

The process is reversed at the microprocessor/sensory side. That is, a single microprocessor is used with multiple sensors (i.e. receivers) that remove the subcarrier from the signal leaving the data as demodulated serial data. The receiver microprocessor then demodulates the ID received. It then passes on the data upstream such that the only relevant information that the signal came from RF or IR is determined by the software when the sensor is programmed into the system. This is referred to at setup or installation. It is only at this time that the system is knowledgeable as to the type of sensor it is (as well as its location).

In this way, a single microprocessor is modulating different signals simultaneously or staggered. Different sensors sensitive to different media and subcarriers and a single microprocessor demodulate data virtually independent of the media. Data then flows through the system without any knowledge of the data routing components along the way with the final software making expert inferences then knowledgeable as to the media the identification signal came in from.

In carrying out the above objects and other objects of the present invention, a method is provided for locating subjects within a tracking environment. The method includes the steps of providing, for each subject, a TAG for transmitting both a substantially line-of-sight signal including a unique TAG ID and a substantially non-line-of-sight signal also including the unique TAG ID. An array of receivers distributed within the tracking environment is also provided, wherein the array of receivers includes an extended area receiver for receiving a plurality of substantially non-line-of-sight signals and a plurality of limited area receivers. Each of the limited area receivers receives substantially line-of-sight signals. An extended area detection packet is generated including the unique TAG ID in response to each received non-line-of-sight signal. The method further includes the step of generating a limited area detection packet including the unique TAG ID in response to each received line-of-sight signal. Finally, the method includes the step of determining the location of each TAG and its associated subject based on the identity of the extended area and limited area receivers for the TAG as represented by its extended area and limited area detection packets.

Preferably, the line-of-sight and non-line-of-sight signals are electromagnetic transmissions such as radio frequency signals and infrared signals.

The above objects and other objects, features, and advantages of the present invention are readily apparent from the following detailed description of the best mode for carrying out the invention when taken in connection with the accompanying drawings.

BRIEF DESCRIPTION OF THE DRAWING FIGURE

FIG. 1 is a schematic block diagram illustrating the method and system of the present invention.

BEST MODE FOR CARRYING OUT THE INVENTION

Referring now to FIG. 1, there is illustrated a system, generally indicated at 10, for locating subjects (i.e. persons and objects) in a tracking environment. In general, the system is a combined infrared and radio frequency locating system which is adapted for use not only in medical applications, but also in non-medical applications. The system 10 is a fully automatic data collection system which provides real-time location information of personnel or equipment (i.e. subjects). Typically, information is collected using an in-ceiling and/or in-wall sensor network connected with common telephone-type wire to make accurate decisions and execute the appropriate responses. Typically, the components of the system 10 are relatively simple and modular.

In general, the system 10 includes a plurality of TAGs or badges, each of which is generally indicated at 12. Each badge 12 is provided for each subject to be tracked within the tracking environment. In general, each badge emits a hemisphere of digitally encoded infrared (i.e. IR) light as indicated by lines 14. Preferably, the digitally encoded infrared light includes a 42 bit packet having a fixed 16 bit ID plus other network information. Typically, the effective range of such infrared light is approximately 15 to 18 feet. The infrared light is a substantially line-of-sight signal.

Each badge 12 also transmits or emits a radio frequency (i.e. RF) signal via an antenna 16. The digitized infrared light and the radio frequency interlace contain badge identification data, page request or alert notification, and condition of a battery 18 contained within each of the badges or TAGs 12.

An RF signal is also generated at a timed interval as a "heartbeat" pulse. This pulse informs the host computer that the badge is both present and fully functional.

The system 10 also includes a receiver assembly including a plurality of infrared receivers 20 which are utilized to receive the badges' infrared signals and transmit coded transmission data along twisted pair connections 22.

The radio frequency signals emitted by the antennas 16 are received by an antenna 24 of a radio frequency receiver 26 which comprises a sensor having a range of approximately 100 to 200 feet in all directions. The radio frequency receiver 26 converts encoded signals emitted by the badges or transmitters 12 into electrical signals which are transmitted via a single twisted pair connection 28.

The signals appearing along the connection 28 as well as the connections 22 are received by a micro-processor-based collector 30 of the receiver assembly which takes the incoming data packets, buffers them and prepares them for transfer to a concentrator 32 of the system 10. The collector 30 assembles data received from the receivers 20 and 26 into a larger network-ready packet. This network-ready packet is then relayed along a twisted wire pair 31. Typically, software for the collector 30 is uploaded via the concentrator 32 along a connection 33. Typically, the microprocessor-based collector 30 can be connected to up to 24 sensors or receivers such as the receivers 20 and the receiver 26.

The concentrator 32 typically scans the collector 30 as well as any other collectors such as a collector 34 connected in a single daisy chain or multidrop configuration to the concentrator 32. In turn, the collector 34 is connected to other receivers (not shown) of the infrared and RF types.

The system 10 also includes an appropriately programmed host computer 36 which receives and processes data packets collected by the concentrator 32.

Referring in detail now to the badges, the topmost badge 12 of FIG. 1 typically includes the battery 18 which may comprise a lithium 3.5 volt type battery. The badge 12 also includes a battery-saving circuit 38 connected to the battery 18 and to a motion detector 40 wherein IR transmissions from the badge 12 are triggered at a higher frequency when the badge 12 is in motion and are gradually reduced in frequency when the badge 12 is at rest to preserve battery life.

Each badge 12 also includes a push button 42 which is manually operable and can be used to request pages or to send alerts by means of a radio frequency transmitter 44 under the control of a microprocessor-based controller 46. While the infrared transmissions from the badge 12 are location specific since infrared signal transmissions do not penetrate walls or floors, the radio frequency signals transmitted or emitted by the radio frequency transmitter 44 under the control of the controller 46 do penetrate walls and floors. The radio frequency transmitter 44 produces supervisory signals approximately every two minutes and page request/alert signals substantially instantaneously upon depression of the push button 42.

The microprocessor-based controller 46 controls the RF transmitter 44 to modulate data including preset, unique identification codes (i.e. TAG ID). For example, a radio frequency data modulation routine provided by the controller 46 typically holds an oscillator contained within the RF transmitter 44 on the entire period the push button 42 is depressed. Preferably, the RF transmitter 44 under the control of the controller 46 uses frequency shift keyed modulation.

In like fashion, an IR transmitter or emitter 48 of the badge 12 under control of the controller 46 modulates the IR transmissions from the transmitter 48. For example, a 447.5 kHz signal, when emitting a carrier on pulse, will turn the LED of the transmitter 48 on and off for so many microseconds (typically 120 microseconds).

The RF receiver 26 typically uses modulating current loop transmission signaling technology for high reliability. Typically, the receiver 26 can be located up to 1,000 feet from its associated collector 30 using standard unshielded twisted pair telephone-type wire. While the receiver 26 and the receivers 20 are typically mounted in acoustic tile, they may be also mounted on walls or other convenient locations.

The modulation process provided for each badge 12 by its controller 46 is reversed within each micro-processor-based collector 30. Each collector 30 removes the subcarrier from the signals appearing on connections 28 and 22, thereby leaving the data as demodulated serial data. The microprocessor within the collector 30 then demodulates the ID data received. It then passes this data upstream such that the only relevant information that the signal came from a radio frequency receiver such as the radio frequency receiver 26 or an infrared receiver such as one of the infrared receivers 20 is determined by the software contained within the host computer 36 when the particular receivers 26 and 20 are programmed into the system 10. Not only is the system 10 knowledgeable as to the type of receiver the data is received from, but also its location.

Typically, the host computer 36, when appropriately programmed, can process the last known infrared location for purposes of servicing a person who has pressed a push button 42 on his associated badge 12. For example, since bathrooms are places where it can be difficult to place infrared receivers 20 and where people may object to such a receiver being present, a push of the push button 42 by a person within such a bathroom will require the host computer 36 to find the last known infrared receiver reception (which is likely to be outside the restroom). Hence, the proper service can be delivered to the person who pressed the push button 42.

While the best mode for carrying out the invention has been described in detail, those familiar with the art to which this invention relates will recognize various alternative designs and embodiments for practicing the invention as defined by the following claims.

What is claimed is:

1. A method for locating subjects within a tracking environment, the method comprising the steps of:

for each subject, providing a TAG capable of transmitting a substantially line-of-sight signal including a unique TAG ID substantially simultaneously with a substantially non-line-of-sight signal also including the unique TAG ID;

providing an array of receivers distributed within the tracking environment, wherein the array of receivers includes an extended area receiver for receiving a plurality of substantially non-line-of-sight signals and a plurality of limited area receivers, each of the limited area receivers receiving substantially line-of-sight signals;

generating an extended area detection packet including the unique TAG ID in response to each received non-line-of-sight signal;

generating a limited area detection packet including the unique TAG ID in response to each received line-of-sight signal; and determining the location of each TAG and its associated subject based on the identity of the extended area and limited area receivers for the TAG as represented by its extended area and limited area detection packets.

2. The method of claim 1 wherein the line-of-sight and non-line-of-sight signals are electromagnetic signals.

3. The method of claim 2 wherein the non-line-of-sight signals are radio frequency (RF) signals and the extended area receiver is an RF receiver.

4. The method of claim 3 wherein the line-of-sight signals are infrared (IR) signals and the limited area receivers are IR receivers.

5. A system for locating subjects within a tracking environment, the system including:

for each subject, a TAG capable of transmitting a substantially line-of-sight signal including a unique TAG ID substantially simultaneously with a substantially non-line-of-sight signal also including the unique TAG ID;

a receiver assembly including an array of receivers distributed within the tracking environment, wherein the array of receivers includes an extended area receiver for receiving a plurality of substantially non-line-of-sight signals, the receiver assembly generating an extended area detection packet including the unique TAG ID in response to each received non-line-of-sight signal, the array of receivers also including a plurality of limited area receivers, each of the limited area receivers receiving substantially line-of-sight signals, the receiver assembly generating a limited area detection packet including the unique TAG ID in response to each received line-of-sight signal;

a data communications controller coupled to the receiver assembly for collecting the extended area and limited area detection packets; and a location processor coupled to the controller for receiving the collected detection packets and for determining the location of each TAG and its associated subject based on the identity of the extended area and limited area receivers for the TAG as represented by its extended area and limited area detection packets.

6. The system as claimed in claim 5 wherein the line-of-sight and non-line-of-sight signals are electromagnetic signals.

7. The system as claimed in claim 6 wherein the non-line-of-sight signals are radio frequency (RF) signals and the extended area receiver is an RF receiver.

8. The system as claimed in claim 7 wherein the line-of-sight signals are infrared (IR) signals and the limited area receivers are IR receivers.

9. The system as claimed in claim 8 wherein each TAG includes an RF transmitter for transmitting its RF signal, an IR transmitter for transmitting its IR signal and a single controller for controllably modulating both the RF and IR signals with its unique TAG ID.

10. The system as claimed in claim 9 wherein the single controller is a microprocessor-based controller.

11. The system as claimed in claim 8 wherein the receiver assembly includes a collector coupled to the RF and IR receivers for controllably demodulating the received RF and IR signals to obtain the extended area and limited area detection packets.

12. The system as claimed in claim 11 wherein the collector includes a single microprocessor for controllably demodulating the received RF and IR signals.

* * * * *